US005299783A

United States Patent [19]

Ledger et al.

[11] Patent Number: 5,299,783

[45] Date of Patent: Apr. 5, 1994

[54] ROD COOLING APPARATUS

[75] Inventors: Alfred R. Ledger, North Grafton; Charles H. Gage, Westborough, both of Mass.

[73] Assignee: Engineered Production Increase, Inc., North Grafton, Mass.

[21] Appl. No.: 947,934

[22] Filed: Sep. 21, 1992

Related U.S. Application Data

[63] Continuation-in-part of Ser. No. 693,720, Apr. 30, 1991, abandoned.

[51] Int. Cl.[5] ..... C21D 9/56

[52] U.S. Cl. ..... 266/106; 266/111

[58] Field of Search ..... 266/103, 106, 111, 102

[56] References Cited

U.S. PATENT DOCUMENTS

| | | | |
|---|---|---|---|
| 4,375,884 | 3/1983 | Grotepass | 266/106 |
| 4,423,856 | 1/1984 | Takahashi et al. | 266/106 |
| 4,546,957 | 10/1985 | Jalil et al. | 266/106 |

*Primary Examiner*—Scott Kastler

*Attorney, Agent, or Firm*—Barlow & Barlow, Ltd.

[57] ABSTRACT

Rod cooling system for use in a rod rolling mill having a laying reel and a conveyor onto an entry portion of which the rod is deposited in overlapping offset rings, entry portion receiving substantial amounts of cooling air for rapid cooling of the rod, the conveyor having a grid for introducing cooling air under the rings for movement in a confined space thereunder and surfaces developing low pressure that draws ambient air through the rings.

8 Claims, 3 Drawing Sheets

FIG. 3
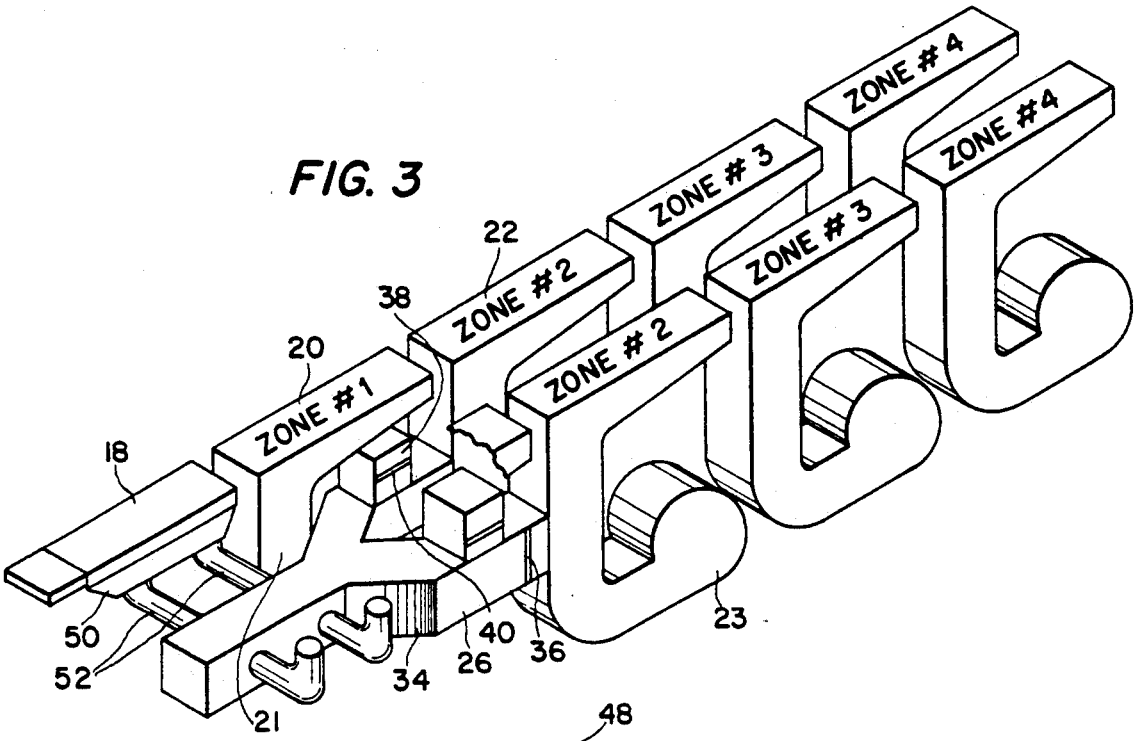
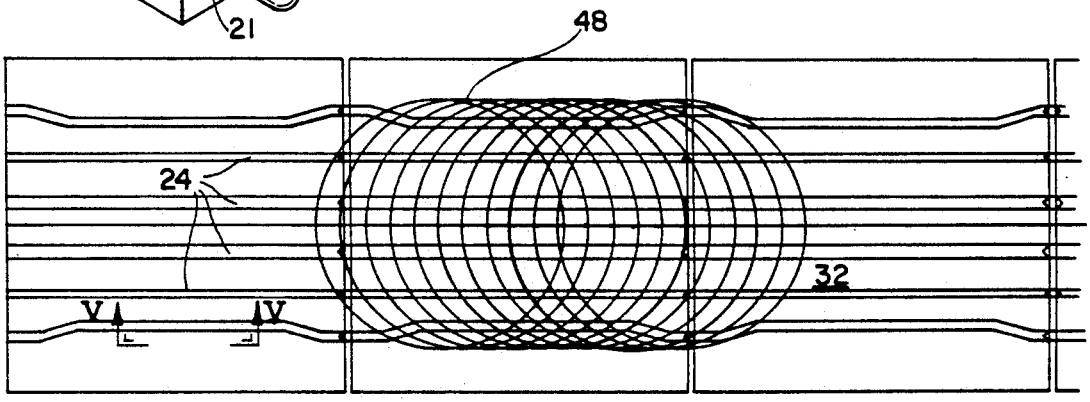
FIG. 4
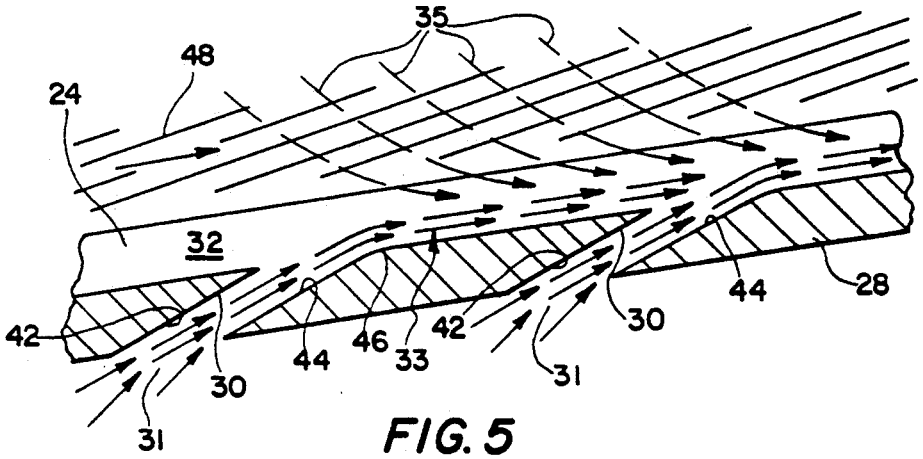
FIG. 5

ROD COOLING APPARATUS

CROSS REFERENCE TO RELATED APPLICATION

This application is a continuation in part of our prior application Ser. No. 07/693,720, filed Apr. 30, 1991, now abandoned.

BACKGROUND OF INVENTION

In the manufacture of steel rod, it has been common practice to form the basic steel ingot into a billet having a square cross-section with dimensions, for instance, of 4"×4" and to allow the billet to cool for storage. The billet is subsequently taken from storage, heated in a reheat furnace and then presented to a multi-stand rod mill. The rod leaves the mill and is formed into coils for storage and/or sale. More specifically, the rod leaves the mill and is water-cooled on its way to the reel which forms the coil. By the time that the rod leaves the reel, it has regained most of its original temperature. Since the rod must be manipulated in order to be removed from the area, it is necessary to cool it; more importantly, however, it is imperative that this cooling take place in a certain manner in order to obtain desired metallurgical properties. For the purpose of such cooling, use has been made in the past of water or molten lead baths, but these systems have presented other unsolvable problems. Subsequently, a system known as the "STELMOR SYSTEM" was developed by the Morgan Construction Company of Worcester, Mass. This system consists of removing the hot rod from the reel in the form of spaced coils that are moved along a conveyor. Handling equipment is located at the located under the conveyor and are subjected to air flow from fans remote discharge end of the conveyor to re-form the coils and move successive coils to another location. With this system, it is possible to regulate the rate of cooling by adjusting fan speed and, on occasion, by providing a cover over the conveyor and coils.

While this system has proved to be adequate for ordinary steel rod, it has some drawbacks, particularly in the case where the rod is formed from alloy steels or when special metallurgical characteristics are desired. Since the rod is usually subjected to further manufacturing processes, such as drawing to form wire or used in header machines to make bolts, the physical character of the finished rod can be quite important. The presence of carbide boundaries in the steel can make it difficult to draw and may damage the dies. The presence of scale can also make the rod difficult to handle and to work.

Attempts have been made in the past to improve the flexibility of the conveyor-type cooling system. For instance, the U.S. patent of JALIL et al U.S. Pat. No. 4,448,401 and its associated U.S. Pat. No. 4,546,957 show a conveyor configuration in which the coils of rod are carried on hollow rollers and the cooling air is directed around the rollers. The patent of JALIL et al U.S. Pat. No. 4,580,353 relates to a roller-type conveyor in which the air is directed upwardly by a special nozzle arrangement. At one time, a system was suggested by Ashlow Engineering Limited of Sheffield, England, in which air has been provided under all parts of the conveyor, including the part under the reel, by a large number of small axial-flow fans, thus giving a certain amount of control of the quantity of air supplied at various parts of the conveyor. All of these systems have presented problems, including the high cost of the equipment and of being limited to use with ordinary steel rod. These and other difficulties experienced with the prior art devices have been obviated in a novel manner by the present invention.

It is, therefore, an outstanding object of the invention to provide a rod cooling system which uses a short conveyor, with subsequent reduction of equipment and building cost.

Another object of this invention is the provision of a rod cooling system that permits the production of favorable metallurgical characteristics in special alloy steels.

A further object of the present invention is the provision of apparatus for the controlled cooling of steel rod, which apparatus operates in such a way as to reduce the formation of carbide inclusions and of scale on the outer surface.

A still further object of the invention is the provision of a rod cooling apparatus that can be applied effectively to existing installations in order to provide faster or adequate cooling without lengthening the conveyor.

It is a further object of the invention to provide a rod cooling apparatus which is simple and rugged in construction, which can be easily manufactured from readily-obtainable materials, and which is capable of a long life of useful service with a minimum of maintenance.

Another object of the invention is the provision of a rod cooling system which can be used with a considerable variety of steel rod with different metallurgical characteristics.

With these and other objects in view, as will be apparent to those skilled in the art, the invention resides in the combination of parts set forth in the specification and covered by the claims appended hereto.

SUMMARY OF THE INVENTION

In general, the present invention relates to a rod cooling system for use with a rolling mill having a reel for forming the rod into overlapping offset rings and having conveying means for carrying the rod to a position of disposal. The conveying means includes a tiltable entry section underlying the reel, followed by at least first and second sequential air cooling zones having individual fans. A duct is attached at one end to the fan of the second zone and at the other end to the underside of the tiltable section. Means is provided to control the volume of air flow into the duct from the second zone fan.

More specifically, a secondary duct leads from the first-mentioned duct to the first zone and means is provided to control the volume of air flow in the said secondary duct. After the rod is subjected to water cooling after it is formed in the finishing stand of the rolling mill, means is provided for forming the rod into the overlapping offset rings and for carrying the rings through a plurality of air cooling zones. Cooling air is applied to the rings at an entry position immediately following the ring-forming means and before passing into the first zone. The velocity of the cooling air in this entry position is substantially greater than in any of the zones and provides a low pressure zone on the deck to draw ambient air downwardly through the rings in order to cool the rod quickly to the transformation stage and to promote fine-grained pearlite in the core of the rod.

BRIEF DESCRIPTION OF THE DRAWINGS

The character of the invention, however, may be best understood by reference to one of its structural forms, as illustrated by the accompanying drawings, in which:

FIG. 3 is a perspective view, with portions removed, of the first portion of the rod cooling system, FIG. 4 is a top plan view of a portion of the system, FIG. 5 is a sectional view of the system, taken on the line V—V of FIG. 4, and FIGS. 6 and 7 are vertical schematic views, showing the rod cooling system as used in two modes of operation.

DESCRIPTION OF THE PREFERRED EMBODIMENT

Figure 1:
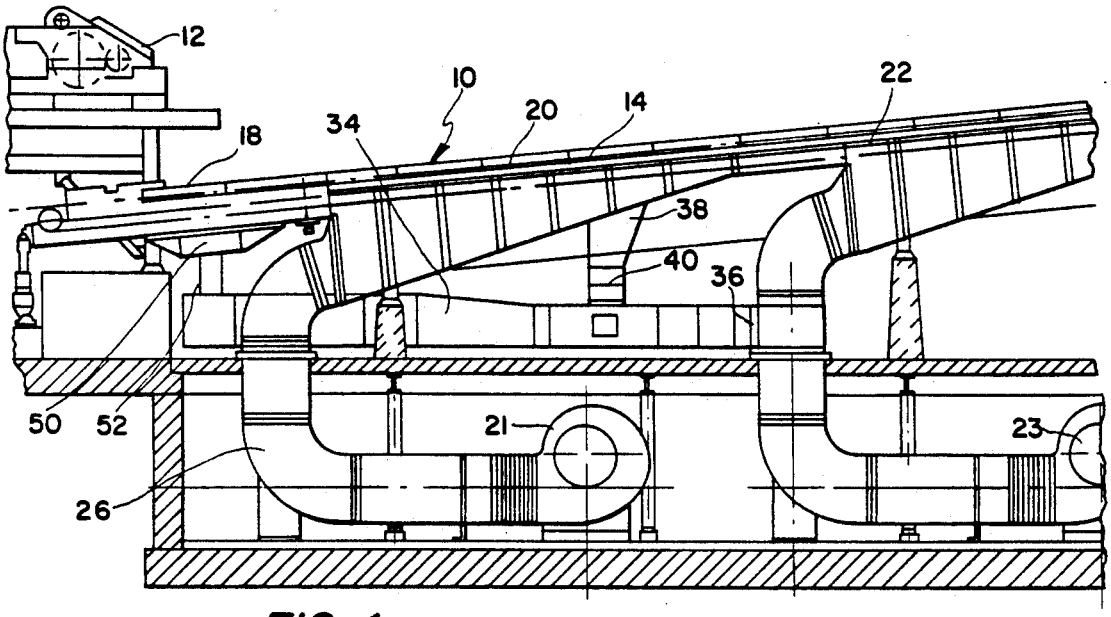
FIG. 1 is a side elevational view of a first portion of a rod cooling system incorporating the principles of the present invention.
Figure 2:
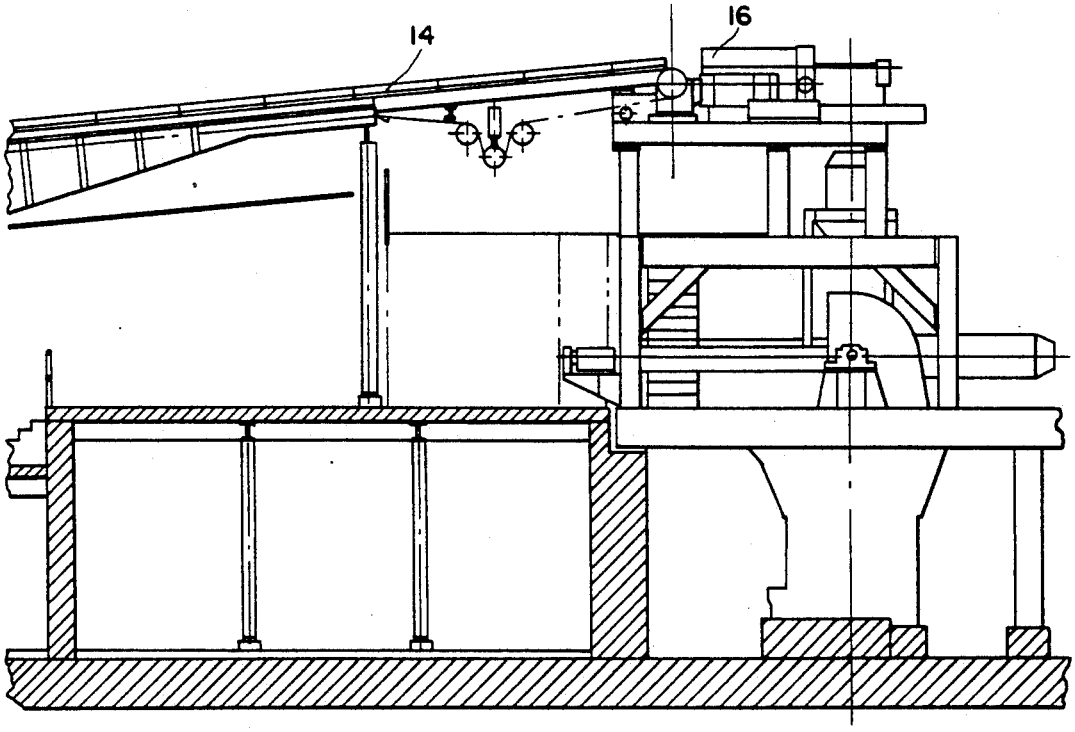
FIG. 2 is a side elevational view of a terminal portion of the rod cooling system.

Referring first to FIGS. 1 and 2, which best show the general features of the invention, the rod cooling system, indicated generally by the reference numeral 10, is shown for use in a rod rolling mill having a laying reel 12 for receiving and coiling the rod. A longitudinal, slightly-inclined conveyor 14 is provided for receiving the rod from the reel 12 and for carrying it to a remote disposal position 16 where handling equipment is located. The conveyor includes a short entry portion 18 underlying the reel, which portion is followed by first and second sequential cooling zone portions 20, 22, each zone portion having its own centrifugal fan 21, 23, respectively.

FIGS. 4 and 5 show the manner in which the conveyor 14 is provided with longitudinally-extending parallel bars, such as I-bars 24 of substantial depth for receiving and supporting the rings on their upper edges. Air supply means 26 (FIG. 3) underlies the conveyor for supplying cooling air to the entry portion 18 and to the zone portions 20, 22. A grid 28 (FIG. 5) underlies the bars and has nozzle-shaped slots 30 extending transversely of the bars for directing the cooling air upwardly at a substantial angle to the vertical into a space 32 defined by the sides of the bars 24 and the undersides of the rings 48.

FIG. 3 shows the details of the air supply means 26 used in a two-strand mill with two spaced, parallel conveyors. A duct 34 is attached at one end to the fan discharge duct of the second zone portion 22 and at the other end to a plenum 50 on the underside of the entry portion 18 A means, such as a damper 36, is provided for controlling the volume of air flow into the duct from the second zone portion fan. A secondary duct 38 leads from the first-mentioned duct 34 to the first zone portion 20 and a means, such as a damper 40, is provided to control the volume of air flow through the said secondary duct.

In FIG. 5, it can be seen that each slot 30 in the grid 28 is defined by two spaced, parallel surfaces 42, 44 extending at an acute angle to the vertical and by an aerodynamic convex surface 46 located at the exit of the slot into the confined space 32 to produce flow of air with a substantial component flowing in a direction parallel to the direction of movement of the rings 48 along the conveyor. The angle may vary from one position to another across the width of the conveyor and, in the preferred embodiment, will extend nearer to the vertical in the center than adjacent the sides. This flow creates a low pressure area along the upper surface of the grid 28 and this draws air downwardly through the rings as seen by the arrows 35.

The entry portion 18 of the conveyor is capable of having its angle adjusted to provide the optimum surface to receive the rings 48 from the reel 12. For that reason, the duct 34 is connected to the plenum 50 underlying the entry portion by compensation means, such as elbow conduits 52, in order to allow flexibility of the system when such angular adjustment is made.

The operation and the advantages of the invention will now be readily understood in view of the above description. In the rod rolling mill, the billet is reheated and passes through the several rolling mill stands until the desired reduction is obtained. From the last or "finish" stand, the rod passes through a water-cooling apparatus and then passes into the laying head 12. The laying head forms the rod into coils and, as the coils drop downwardly onto the moving conveyor, they are spread into overlapping offset rings 48 and are carried along the conveyor by the chain. Eventually, a given ring arrives at the remote position 16 where apparatus is located to establish complete coils for subsequent handling. As the rings pass from the reel to the handling location, they are subjected to cooling air that originates in fans and plenum boxes under the conveyor and passes upwardly through the rings.

Figure 6:
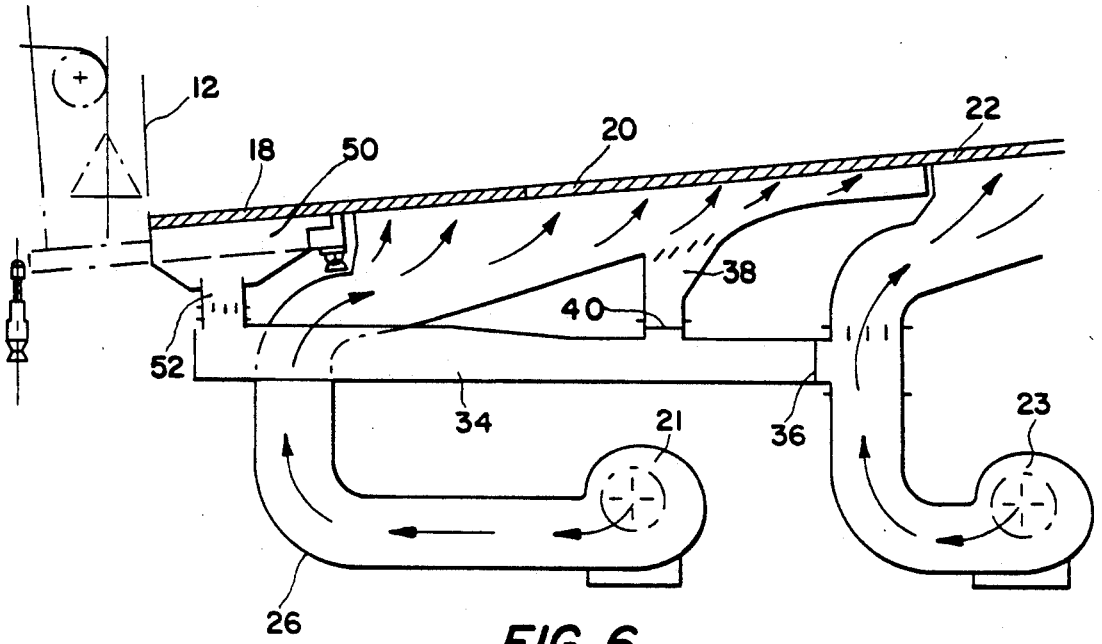

FIG. 6 shows the manner of operation when the rod is to be subjected to slow cooling. The fans 21,23 serving the first zone portion 20 and the second zone portion 22 provide their respective portions with substantial cooling air, but the entry portion 18 receives no air. This is because the dampers 36 and 40 are closed and no air passes through the duct 34 to the first or entry portion. In effect, in this mode of operation, the rod receives a leisurely cooling in the first and second zone portions, as well as similar zone portions on the way to the remote handling location 16. This type of cooling is adequate for most common types of steel.

Figure 7:
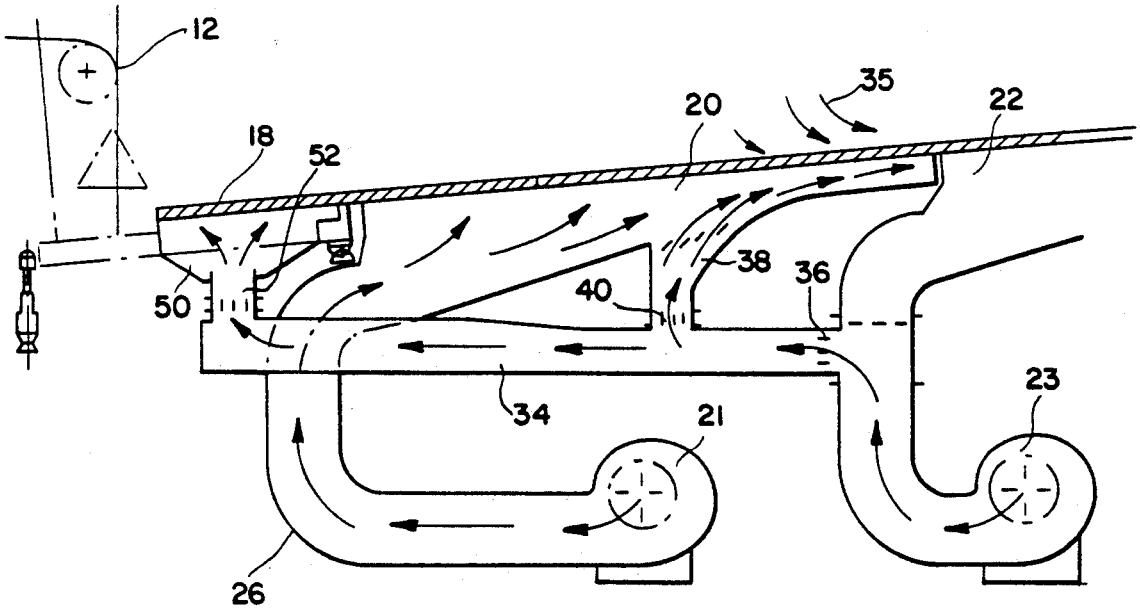

FIG. 7 shows the operation that is possible with the present invention, when the particular steel being manufactured needs a special treatment. Usually, with this type of steel it has been found that a very rapid cooling immediately after leaving the reel brings about excellent metallurgical characteristics. This rapid cooling takes place at the entry portion 18 when the damper 36 has been opened, so that a substantial flow of air passes into the duct 34 from the fan 23 that would normally serve the second zone portion 22. This air passes upwardly through the elbow conduits 52 into the small plenum 50 underlying the entry portion. Under some conditions, as illustrated, the damper 40 can be opened, so that some of the air from the second zone portion 22 goes to the first zone portion 20 to reinforce the flow from its own fan 21. Naturally, the second zone portion receives very little cooling air under such settings of the dampers.

The effect of causing the air from the second zone portion fan to pass instead to the small entry portion 18 is that the rod is cooled very rapidly from the reel temperature by the high volume of air and, as a matter of practice, the rod temperature passes quickly through the "knee" of the TTT diagram, thus preventing the formation of undesirable forms of crystal structure in the metal.

The advantages of the invention are evident. First of all, it is possible to treat certain types of steel rod in such a way that the quality of the finished product is excellent. Very little carbide or scale is formed that would otherwise make the product difficult to draw and difficult to machine. Furthermore, in the larger sizes of rod, it is difficult to cool the core rapidly enough, while the outer layers cool adequately; in some cases, the core of larger sizes stores so much heat, because of its large volume, that the entire metallurgical treatment is dominated by that fact. Also, it is possible with the present invention to reduce substantially the formation of scale by quickly reducing the temperature of the outer layers of the rod.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

We claim:

1. Rod cooling system for use in a rod rolling mill having a laying head for receiving and coiling the rod, comprising (a) a longitudinal conveyor for receiving the rod from the laying head and carrying it to a remote disposal position, the conveyor including an entry portion underlying the laying head and followed by first and second sequential cooling zone portions, the conveyor having longitudinally-extending parallel bars of substantial depth for receiving and supporting the rings on their upper edges, (b) air supply means underlying the conveyor for supplying cooling air to the entry portion and to the zone portions, and (c) a grid underlying the bars and having nozzle-shaped slots extending transversely of the bars and at a small angle to the grid for directing the cooling air into a space defined by the sides of the bars and the undersides of the rings, each slot being defined by two spaced, parallel surfaces to provide a throat and by an arcuate convex surface located at the exit of the slot into the space to produce substantial low pressure high velocity flow of air along the undersides of the rings whereby ambient air is drawn through the rings.

2. Rod cooling system as recited in claim 1, wherein the conveyor is of the chain type, and wherein the air supply means includes centrifugal fans.

3. Rod cooling system as recited in claim 1, wherein a duct is attached to one end to the second zone portion and at the other end to the underside of the entry portion, and wherein means is provided for controlling the volume of air flow into the duct from the second zone portion.

4. Rod cooling system as recited in claim 2, wherein a secondary duct leads from the first-mentioned duct to the first zone portion, and wherein means is provided to control the volume of air flow through the said secondary duct.

5. Rod cooling system for use in a rod rolling mill having a reel for receiving and coiling the rod, comprising (a) a conveyor receiving the rod from the laying head in the form of overlapping offset rings and carrying it to a remote position of disposal, the conveyor including an apertured entry portion underlying the laying head, followed by at least first and second cooling zone portions, first air supply means underlying the conveyor for supplying air to the second zone portion, the entry portion being tiltable to control the presentation of the rod from the reel, the laying head depositing the rod directly onto the entry portion, and (b) means supplying substantial amounts of cooling air to the entry portion to pass through the apertures to cool the rod quickly to transformation, a duct attached at one end to the second zone and at the other end to the underside of the entry portion, means for controlling the volume of air flow through the duct from the said second zone portion, said entry and first portion being substantially smaller than the following cooling portions so that the volume of air through the apertures in the entry and first portion is much higher than in the following portions.

6. Rod cooling system as recited in claim 5, wherein a secondary duct leads from the first-mentioned duct to the first zone, and wherein means is provided to control the volume of air flow through the said secondary duct.

7. Rod rolling system for use in a rod rolling mill having a laying head for receiving and coiling the rod, comprising (a) a longitudinally-extending conveyor having means for moving the rod and having longitudinally-extending parallel bars for receiving and supporting the rod as it is moved from the laying head in the form of overlapping offset rings, the bars having substantial depth and an upper edge on which the rings are supported, (b) air supply means underlying the conveyor, and (c) a grid underlying the bars and having nozzle-shaped slot extending transversely of the bars for directing air into a space defined by the sides of the bars and the undersides of the rings, (d) each slot being defined by two spaced, parallel surfaces and by an arcuate aerodynamic surface located at the exit of the slot into the said space to produce a substantial flow of air in a direction parallel to the movement of the rings along the conveyor and a low pressure zone in said space whereby ambient air is drawn through said rings.

8. Rod cooling system as recited in claim 7, wherein the angle at which the air is directed varies from place to place across the width of the conveyor, the angle in the center being closer to the vertical than the angles adjacent the sides.

* * * * *

UNITED STATES PATENT AND TRADEMARK OFFICE

CERTIFICATE OF CORRECTION

PATENT NO. : 5,299,783

DATED : April 5, 1994

INVENTOR(S) : Leger, Alfred R.
Gage, Charles H.

It is certified that error appears in the above-identified patent and that said Letters Patent is hereby corrected as shown below:

On the title page: Item [19] & [75]

Inventor:Leger, Alfred R.

Signed and Sealed this

Fourteenth Day of June, 1994

*Attest:*

*Attesting Officer*

BRUCE LEHMAN

*Commissioner of Patents and Trademarks*